United States Patent [19]

Swenson, Jr. et al.

[11] Patent Number: 4,681,510

[45] Date of Patent: Jul. 21, 1987

[54] PUMP FOR SATURATED LIQUID

[75] Inventors: Paul F. Swenson, Jr., Shaker Heights; Charles E. Heinrich, Mentor, both of Ohio

[73] Assignee: TRD Corporation, Cleveland, Ohio

[21] Appl. No.: 815,572

[22] Filed: Jan. 2, 1986

[51] Int. Cl.[4] ..... F04D 25/08

[52] U.S. Cl. ..... 415/168; 415/121 A

[58] Field of Search ..... 415/168, 121 A, 90, 415/169 R, 169 A; 417/435

[56] References Cited

U.S. PATENT DOCUMENTS

| | | | |
|---|---|---|---|
| 2,921,533 | 1/1960 | Williams | 415/169 A |
| 4,116,592 | 9/1978 | Cherny et al. | 415/90 |
| 4,436,490 | 3/1984 | Schönwald | 415/90 |

FOREIGN PATENT DOCUMENTS

| | | | |
|---|---|---|---|
| 2750801 | 5/1979 | Fed. Rep. of Germany | 415/169 R |
| 478747 | 3/1953 | Italy | 415/169 |
| 123654 | of 1919 | United Kingdom | 415/169 |
| 1218178 | 1/1971 | United Kingdom | 415/90 |

*Primary Examiner*—Robert E. Garrett
*Assistant Examiner*—John Kwon
*Attorney, Agent, or Firm*—Daniel G. Blackhurst

[57] ABSTRACT

A pump especially suited for pumping a saturated liquid while employing motive power from a high speed rotor. The disclosed pump comprises a stationary, generally cylindrical inner wall on which is mounted a sleeve member defining a generally cylindrical outer wall radially spaced from the inner wall to define an elongated annular chamber. The outer wall is mounted for rotation relative to the inner wall and at one end of the annular chamber there is a rotarty impeller which rotates relative to the inner wall to direct fluid radially outwardly from adjacent the surface of the outer wall. Fluid supply inlet openings are provided to supply fluid through the inner wall to the annular chamber at a position axially spaced from the impeller. A vapor discharge outlet is carried by the sleeve member and provided with an inlet adjacent the inner wall at a location spaced from the fluid inlet in a direction opposite the impeller.

4 Claims, 3 Drawing Figures

PUMP FOR SATURATED LIQUID

BACKGROUND OF THE INVENTION

The subject invention is directed toward the art of pumps and, more particularly, to a pump especially suited for pumping a saturated liquid while employing motive power from a high speed rotor.

The invention will be described with reference to its use as a low volume condensate pump in the turbine unit of a closed cycle vapor power system; however, as will become apparent, the invention could be used in a variety of environments for many purposes.

As used in the subject specification and claims, a saturated liquid is one which contains a quantity of heat such that addition of further heat causes a portion of the liquid to be vaporized. Pumping such liquids mechanically is difficult because the act of impelling the liquids through the pump adds heat to the fluid and unless the pressure on the liquid increases proportionally "flashing" or vaporization of a portion of the liquid occurs. The presence of the vapor in the liquid being pumped then creates additional difficulties by partially blocking the inlet to the pump and decreasing the effectiveness and efficiency of the pumping operation, thereby inputing more heat to the liquid and generatng more vapor until the pump becomes vapor bound and ceases operation.

There are many approaches by which the problem of vapor binding can be overcome including precooling the fluid, cooling the pump, etc. However, when the pump is used in a vapor power system or similar system in which conservation of heat is important, such approaches can have a detrimental effect on overall system efficiency.

BRIEF DESCRIPTION OF THE INVENTION

The subject invention overcomes the noted problems with an extremely simple centrifugal pump design which is especially suited for pumping saturated liquids without vapor binding. Specifically, in accordance with one aspect of the invention, the pump comprises a generally cylindrical inner wall on which is mounted means defining a generally cylindrical outer wall radially spaced from the inner wall to form an elongted annular chamber. The outer wall is mounted for rotation relative to the inner wall, and one end of the annular chamber there is a rotary pump impeller means which rotates relative to the inner wall to direct fluid radially outwardly from adjacent the surface of the outer wall. Means are provided to supply fluid to the annular chamber at a position spaced from the impeller and through the inner wall. Vapor discharge means are provided with an inlet adjacent the inner wall at a location spaced from the fluid inlet in a direction opposite the impeller.

Preferably, and in accordance with a more limited aspect of the invention, the impeller means is carried by and mounted for rotation with the outer wall.

In operation, the entering fluid collects adjacent the outer wall and is maintained in engagement therewith by centrifugal force as it flows along the wall to the impeller. Any vapor in the fluid is less affected by the centrifugal force and collects adjacent the inner wall and moves toward the vapor outlet. From the vapor outlet, the vapor is discharged to atmosphere or back into the system at a point where the local static pressure is less than the pressure in the annular space plus vapor pump head.

By the arrangement described, the device acts as a combined centrifugal pump and liquid-gas separator. It can be made in a variety of sizes and works especially well in small sizes. Fluid discharge of 25 psia and above can be easily achieved when pumping saturated water initially at a pressure of 1 psia or less.

In accordance with a more limited aspect of the invention, the vapor discharge outlet comprises one or more vent tube members extending radially inwardly from the outer wall and having an opening adjacent the inner wall. The rotation of the vent tube members act to expel the vapor in the manner of a centrifugal pump and produces a vacuum within the annular chamber. This produces lift on the liquid in the supply inlet.

OBJECTS OF THE INVENTION

A primary object of the invention is the provision of an extremely simple pump which can handle fluids near or at their saturation point without experiencing vapor binding.

Another object is the provision of a pump of the type described which is particularly useful as a condensate return pump in a closed cycle vapor power system.

A further object is the provision of a centrifugal pump which includes means for expelling vapor produced in the pump without degrading pump performance.

BRIEF DESCRIPTION OF THE DRAWINGS

The above and other objects and advantages will become apparent from the accompanying description when read in conjunction with the accompanying drawing wherein:

Referring more particularly to the drawing wherein the showings are for the purpose of illustrating a preferred embodiment of the invention, and not for the purpose of limiting the same, FIG. 1 shows the overall arrangement of the inventive pump incorporated in the turbine unit 10 used in a self-contained, closed cycle, vapor power driven heating system of the type shown in the commonly assigned U.S. Pat. No. 4,295,606. As shown, the turbine unit 10 comprises a housing assembly 12 including an upper housing component 14 and a lower housing component 16 having its lower end closed by a bottom plate 18 suitably welded in place. Components 14 and 16 are sealed and joined at their juncture by an O-ring 20 and a conventional clamp ring 22.

Figure 1:
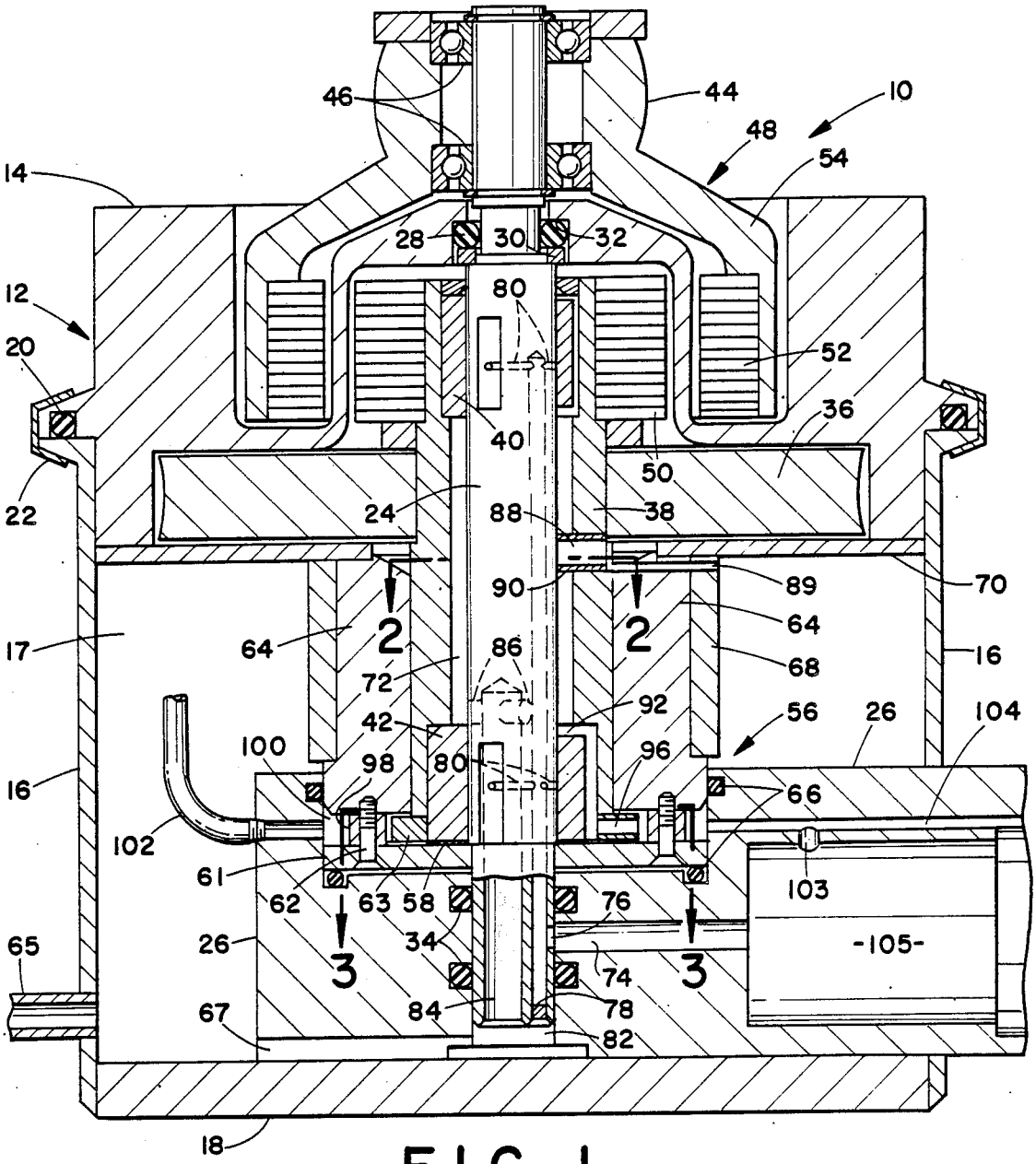
FIG. 1 is a vertical cross-section of a turbine unit including a pump constructed in accordance with a preferred embodiment of the invention; and, FIGS. 2 and 3 are cross-sectional views taken on lines 2—2 and 3—3, respectively, of FIG. 1.

Extending vertically upwardly through housing 12 is a stationary shaft or center post 24. The post 24 is supported at its lower end in a base member 26 and at its upper end by housing component 14. In the embodiment under consideration, base member 26 is carried by bottom plate 18 and joined thereto by welding or the like. The post 24 is sealed where it passes through component 14 by an O-ring 28 held between a ring 30 and a shoulder 32. Suitable O-ring seals 34 are also positioned about the lower end of post 24 as shown.

Rotatably mounted relative to post 24 is a vapor turbine wheel 36 fixedly mounted on a central sleeve member 38. Vapor for driving turbine wheel 36 is supplied from an associated vapor generator through suitable nozzles (not shown).

In the embodiment illustrated, sleeve 38 is rotatable relative to post 24 on suitable upper and lower sleeve bearing 40, 42. Downward thrust of sleeve 38 is carried by the lower end face of bearing 42.

Turbine wheel 36 is drivingly connected to an output pulley 44 rotatably mounted on the upper end of post 24 by bearings 46. In the embodiment shown, the drive connection between turbine wheel 36 and output pulley 44 is a magnetic coupling 48 which includes a first magnetic ring member 50 carried on and joined to the upper end of sleeve member 38 for rotation therewith. A second magnetic ring member 52 carried by and joined to the downwardly extending collar or skirt 54 of output pulley 44. The two ring members 50, 52 thus magnetically couple the sleeve 38 to pulley 44. As is apparent, at least that portion of housing component 14 which extends between ring members 50, 52 must be magnetically permeable.

The arrangement thus far described allows the turbine wheel 36 to operate in a total sealed housing and its output to be conducted out of the housing without the need for moving seals.

Of importance to the subject invention is the arrangement whereby turbine 36 also drives the condensate pump assembly 56 in addition to the output pulley 44. As shown, sleeve 38 is spaced radially outwardly of the outer surface of post 24 by upper and lower sleeve bearings 40, 42 which, as noted, are fixed in sleeve 38 and rotate on post 24. Sleeve 38 is supported at its lower end by a thrust surface pair formed by the bottom of lower sleeve bearing 42 and the top of a thrust washer or disk 58 carried by a plate 61. As shown, plate 61 is connected by screws 62 to an annular housing member 64 which closely surrounds sleeve 38. As shown, member 64 and disk 61 are sealed relative to base member 26 by suitable seals 66. The upper end of member 64 is joined to a sleeve 68 and a horizontal plate 70 which is connected to the bottom housing member 14.

The outward spacing of the inner wall of sleeve 38 in conjunction with the outer wall of post 24 defines a closed, annular chamber 72. Condensate at or near its saturation point is supplied to the sealed chamber 17 which is formed between housing 16 and pump assembly 56. The condensate enters chamber 17 through a condensate return line 65 and flows through a channel 67 formed in block 26 to chamber 82 beneath post 24.

From chamber 82 the condensate flows up a vertically extending passage 84 to transversely extending ports 86 which open to the annular cavity or chamber 72.

Figure 2:
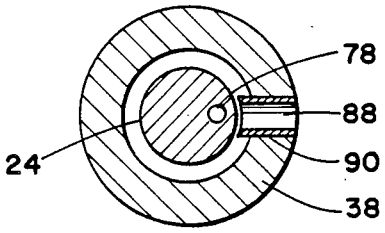

From the chamber 72 there are two exits. A vapor exit 88 (see FIGS. 1 and 2) is located above the inlet openings 86 and is defined by a pipe or tube 90 extending radially from sleeve 38 inwardly to a point where its inner end opens closely adjacent post 24. A liquid discharge or outlet is defined at the lower end of the chamber by three grooves 92 formed in the upper exterior end of bearing 42.

Figure 3:
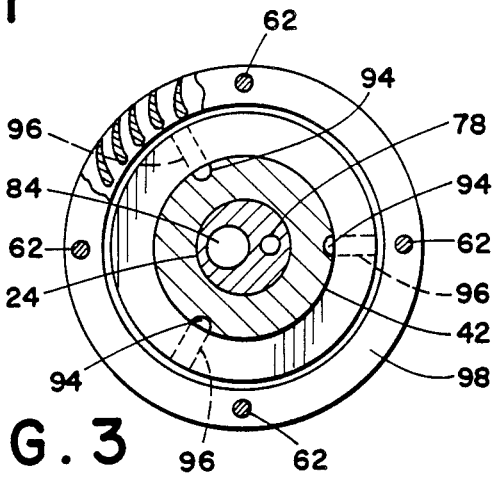

Grooves or passageways 92 lead to axially extending pasages 94 (see FIG. 3) formed in the outer side walls of bearing member 42. Passages 94 connect at their lower end with radially extending pump passages 96 formed in disk 63 which is connected to and carried by the lower end of sleeve 38. Disk 63 may have radial grooves formed on upper and and lower faces to enhance fluid sealing, to minimize leakage around the pump. Passages 96 function in the manner of a centrifugal pump and impel fluid from grooves 94 outwardly through diffuser ring 98. Drilled passages 96 are used in the subject embodiment rather than a more conventional centrifugal pump impeller; however, a more standard impeller could be used if desired.

As shown, a chamber 100 is formed about the exterior of diffuser ring 98 and receives the condensate passing therethrough.

In operation, the condensate entering chamber 72 is subject to a centrifuge action. This separates the vapor and liquid portions. The vapor is pumped through vapor exit 88 and passage 89 into the chamber 17. The liquid is brought up to rotating speed in annular cavity 72 and flows through channels 92, 94 and into pump grooves or passageways 96. In passageways 96 the liquid is, of course, accelerated further into diffuser ring 98 and through a passage 102 in block 26. Passage 102 connects with a passage 104 that returns the condensate to the boiler or vapor generator (not shown).

Also connected with passage 102 is a passage 103 which leads to a filter chamber 105. Filtered condensate from chamber 105 passes through a channel 74 to a port 76 formed in the side of post 24. As shown, port 76 opens to a vertically extending passage 78 formed in post 24 and connecting to small outlet passages 80 leading to bearings 40, 42. Thus, filtered condensate is continuously supplied as lubricant to the bearings.

As discussed, the pump diffuser and impeller may be of any appropriate design:

(1) bladed impeller and a toroidal diffuser for moderate to large specific speeds, (2) drilled port impeller and close-fitting annular diffuser for lower specific speed applications.

With respect to alternative number (2) as shown in the subject embodiment, specific speed is related to the volume pumped and head rise generated; the greater the volume or the lower the head rise, the greater the specific speed.

The invention has been described in a manner to allow one of ordinary skill in the art to make and use the same. Obviously, modifications and alterations of the preferred embodiment will occur to others upon a reading and understanding of the specification. It is our intention to include all such modifications and alterations as part of our invention insofar as they come within the scope of the appended claims.

Having thus described our invention, we claim:

1. A pump especially suited for pumping saturated liquids comprising:

(a) a first member defining a generally cylindrical inner wall;

(b) a second member mounted for rotation on said first member and defining a generally cylindrical outer wall radially spaced from said inner wall to form an elongated annular chamber;

(c) means for driving said second member for rotation relative to said first member;

(d) a rotary pump impeller mounted closely adjacent an end of said annular chamber, said pump impeller being mounted for rotation with said second member;

(e) means for supplying liquid through said inner wall to said annular chamber at a location axially spaced from said impeller; and, (f) vapor discharge means carried by said second member and extending through said annular chamber and terminating in an inlet end located adjacent the inner wall at a position axially spaced from said inlet in a direction opposite said impeller.

2. The pump as defined in claim 1 wherein said first and second members are mounted such that said elongated annular chamber extends vertically and said impeller is mounted at the lower end of said chamber.

3. The pump as defined in claim 2 wherein said vapor discharge means is defined by a tube extending inwardly of said chamber from said second member.

4. The pump as defined in claim 2 wherein said means for supplying liquid comprises a passageway formed vertically through said first member and terminating in a generally radially directed outlet opening.

* * * * *